US011038252B1

(12) United States Patent
Reynolds et al.

(10) Patent No.: US 11,038,252 B1
(45) Date of Patent: Jun. 15, 2021

(54) DEPLOYABLE LOOP ANTENNA

(71) Applicant: The Government of the United States as represented by the Secretary of the Air Force, Kirtland AFB, NM (US)

(72) Inventors: Whitney D. Reynolds, Mesa, AZ (US); Peter S. Ericksen, Baltimore, MD (US)

(73) Assignee: The Government ot the United States of America as represented by the Secretary of the Air Force, Kirtland AFB, NM (US)

( * ) Notice: Subject to any disclaimer, the term of this patent is extended or adjusted under 35 U.S.C. 154(b) by 48 days.

(21) Appl. No.: 16/552,016

(22) Filed: Aug. 27, 2019

(51) Int. Cl.
*H01Q 1/08* (2006.01)
*H01Q 15/16* (2006.01)
*H01Q 1/52* (2006.01)

(52) U.S. Cl.
CPC ..... *H01Q 1/087* (2013.01); *H01Q 1/52* (2013.01); *H01Q 15/161* (2013.01)

(58) Field of Classification Search
CPC .. H01Q 1/08; H01Q 1/36; H01Q 7/02; H01Q 7/06; H01Q 7/08
See application file for complete search history.

(56) References Cited

U.S. PATENT DOCUMENTS 1,689,400 A * 10/1928 Manley ..... H01Q 1/44 343/868
3,560,983 A * 2/1971 Willie et al. ..... H01Q 7/00 343/744
4,249,185 A * 2/1981 De Cesari ..... H01Q 1/08 343/871
5,949,384 A * 9/1999 Ikushima ..... H01Q 7/02 343/866
8,019,302 B2 * 9/2011 Hu ..... H01Q 7/00 455/274
2006/0238430 A1 * 10/2006 Morioka ..... H01Q 7/04 343/742
2011/0221646 A1 * 9/2011 Dresel ..... H01Q 11/10 343/792.5
2013/0342406 A1 * 12/2013 Magid ..... H01Q 1/32 343/715

* cited by examiner

*Primary Examiner* — Tung X Le
(74) *Attorney, Agent, or Firm* — AFNWC/JA; David L. Narciso

(57) ABSTRACT

A base, a spool, and an antenna structure coupled to the spool has ends that are affixed to the base. The antenna structure is wound about the spool in a stowed state, and unwound to form a loop antenna in the deployed state. The antenna structure may be a bistable composite tape with a cross-sectional curvature and having one or more antenna conductors embedded therein. A storage containment device holds the antenna structure in the stowed state. When in the stored state, the antenna structure generates a strain force against the spool biased to unwind and deploy the antenna structure to form a loop antenna when released. Another embodiment adds a second spool rotating in a direction opposite the first to achieve either state. A further embodiment uses two loop antennas by winding two antenna structures around two pairs of spools, respectively.

18 Claims, 5 Drawing Sheets

DEPLOYABLE LOOP ANTENNA

GOVERNMENT INTEREST

The invention described herein may be manufactured and used by or for the Government of the United States for all governmental purposes without the payment of any royalty.

FIELD OF THE INVENTION

The present invention relates to the field of antennas, and more particularly, to deployable antennas for space vehicles.

BACKGROUND OF THE INVENTION

Antennas are used in a number of terrestrial and orbital applications. With larger apertures being attractive for their higher gain, it is desirable to deploy space-based antennas from a small storage volume. This allows large antennas to fit within the confines of the launch vehicle and more easily survive the dynamic loading of the launch vehicle.

For example, U.S. Pat. No. 5,969,695 to Bassily et al., entitled "Mesh Tensioning, Retention and Management Systems for Large Deployable Reflectors," relates to systems for controlling and retaining tension in a mesh reflector in the deployed condition, as well as for managing the mesh during launch and transport in the stowed condition.

U.S. Pat. No. 5,313,221 to Denton entitled "Self-deployable Phased Array Radar Antenna," is directed to a phased array monopole antenna that has a single layer membrane upon which a plurality of antenna units are attached. Each antenna unit has a flexible curved antenna blade which bends over or springs up when the membrane is rolled or unrolled on a drum.

Also, U.S. Patent Application No. 2012/0167943 to Blanchard et al., entitled "Unwindable Flat Solar Generator," is directed to a solar generator deployment device that includes an assembly having a plurality of tape-springs supporting a windable membrane on a face of which is arranged a plurality of elements capable of converting the solar energy into electrical energy. The tape-springs and membrane are co-wound around a unique radius of curvature equal to the natural radius of curvature of folding of the tape-spring in the wound state.

Tape-springs are known as being tapes capable of changing from the wound state to the unwound state essentially by virtue of their own elastic energy. In the unwound state, tape-springs normally have a rigidity which is capable of maintaining them in that state. Conventional tape-springs are generally metallic, and it may be difficult to control their unfolding.

However, conventional tape-springs made of composite material have also been developed and make it possible to better control their winding radius. They also have a high rigidity/weight ratio and a low expansion coefficient.

Various studies indicate that it is possible to render a composite tape-spring bistable. Such studies include "Carbon Fibre Reinforced Plastic First antenna structure s", J. C. H. Yee et al., AIAA 2004-1819, and "Analytical models for bistable cylindrical shells", S. D. Guest et al. Such bistable tape-springs are mechanically stable both in the unwound state and in the wound state. The bistable tape-springs remain stable in the wound state around their natural radius of curvature, without external force. All that is needed is to unfold one end thereof, with a force of low intensity, exerted by a motor-drive system for example, to trigger the unwinding.

However, there may be a need for a space loop antenna that is self-deployable from a compact storage size without the use of motors or actuators.

This background information is provided to reveal information believed by the applicant to be of possible relevance to the present invention. No admission is necessarily intended, nor should be construed, that any of the preceding description constitutes prior art against the present invention.

BRIEF SUMMARY OF THE INVENTION

With the above in mind, embodiments of the present invention are related to a loop antenna for use in space that is self-deployable from a compact storage space without the use of motors or actuators.

Advantages may be provided by an embodiment that is directed to an antenna including a base, at least one spool, and an antenna structure coupled to the spool or spools having ends that are affixed at the base, the antenna structure being configured to actuate between a stowed state and a deployed state. The stowed state is defined by the antenna structure being wound or coiled about the spool(s). The deployed state is defined by the antenna structure being unwound from the spool(s) to form a loop.

The antenna structure may be a bistable composite tape having one or more antenna conductors embedded therein. The bistable composite tape has a cross-sectional curvature. The bistable composite tape may be a bistable fiber-reinforced composite tape including first and second forty-five degree (45°) biased woven layers and a unidirectional lamina layer sandwiched therebetween. Additionally, multiple loop antenna connectors may be embedded in the bistable composite tape. The connectors may lie in parallel.

The ends of the antenna structure are affixed to the base such that in the stowed state, the antenna structure generates and stores a strain force applied to the spool(s) which is biased toward the deployed state. A storage containment device is configured to hold the antenna structure in the stowed state, and a release mechanism configured to release the antenna structure so that, without external assistance, the coiled antenna structure unwinds into the deployed state.

The antenna structure is comprised of two connected sections, with each having a curved cross section with a radius of curvature. The respective curved cross sections form concave surfaces facing in opposite directions when the antenna structure is in the deployed state. The cross sections are flattened when the sections are wound around the spool in the stored state.

Advantages may be provided by another embodiment of an antenna including a base, first and second spools, an antenna structure coupled to each of the spools and having ends affixed to the base, the antenna structure being configured to actuate between a stowed state and a deployed state. The stowed state is defined by respective portions of the first antenna structure being wound or coiled about the first and second spools, and the deployed state is defined by the antenna structure being unwound from about the first and second spools to form a first loop.

Additionally, or alternatively, the antenna may include third and fourth spools, and a second antenna structure coupled to each of the third and fourth spools and having ends that are affixed at the base, with the second antenna structure being configured to actuate between the stowed state and the deployed state. The stowed state is also defined by respective portions of the second antenna structure being wound about the third and fourth spools, and the deployed state is also defined by the second antenna structure being unwound from about the third and fourth spools to form a second loop. The first and second loops would lie in respective intersecting planes. The planes could intersect orthogonally.

DETAILED DESCRIPTION OF THE INVENTION

Figure 1:
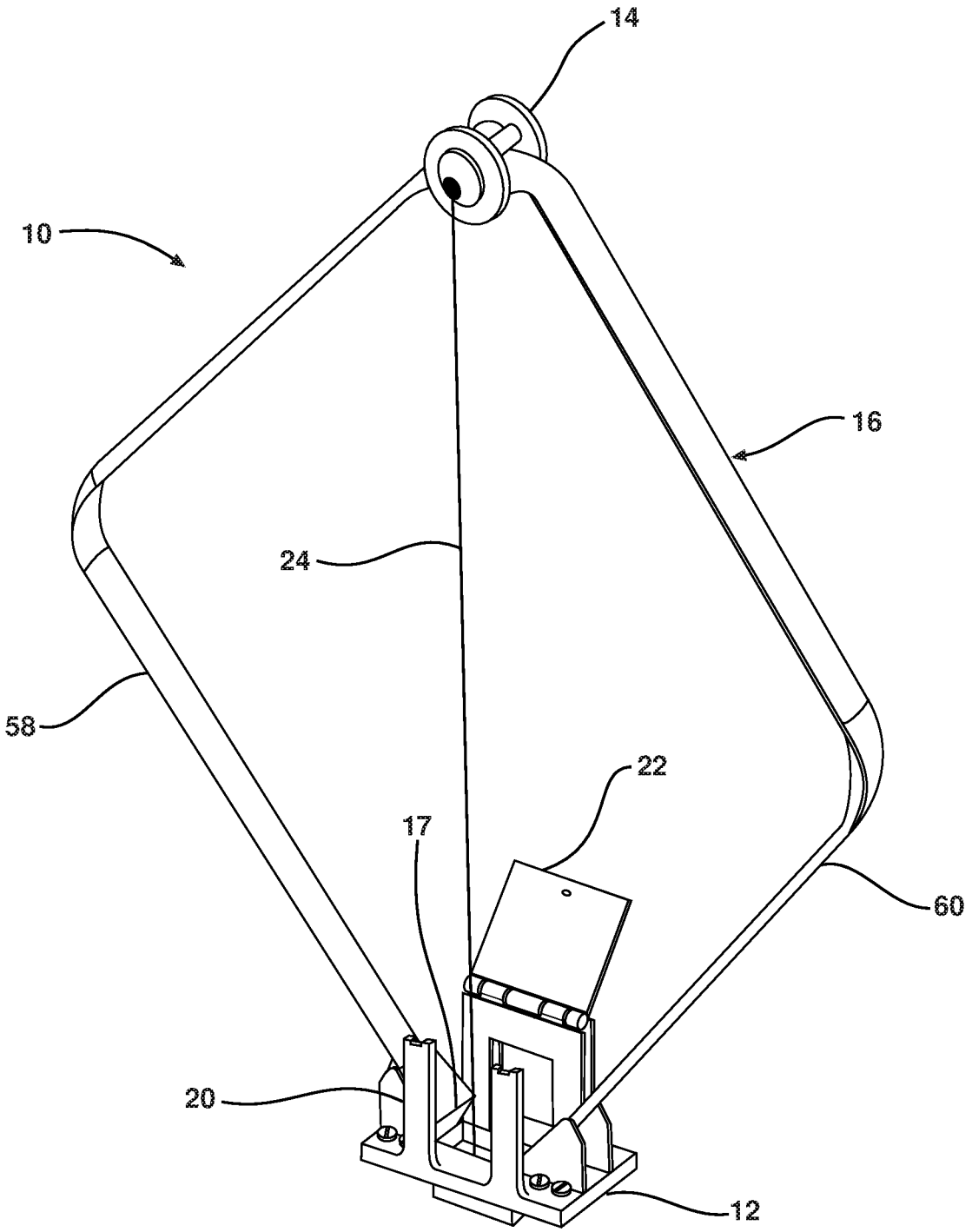
FIG. 1 is a perspective view of an embodiment of a deployable loop antenna using one spool, according to features of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

The present embodiments may provide a loop antenna that is remotely deployable from a small storage size, yet that presents a larger aperture when deployed so as to deliver high gain. Such a storage and deployment approach enables larger loop antennas to fit within the confines of a space-limited launch vehicle and more easily survive the dynamic loading of the launch vehicle, and then to deploy to a pre-determined, operable shape upon demand.

The features that deliver these advantages may be found in the rolling of the loop antenna structure around a single or double spool that is deployed in a loop (e.g. in either a diamond or circular loop configuration), and the use of thin flexible and bistable composite tape elements with electrical antenna conductors embedded therein.

A notable use of the deployable loop antenna is for a radio frequency (RF) receive antenna, either for communications or for passive measurement of RF fields or returns from an ionosphere sounding device in terrestrial and orbital applications.

Turning to the drawings, FIG. 1 is a perspective view of a deployable loop antenna 10 according to features of the present invention. Loop antenna 10 includes base 12, rotatable spool 14, and antenna structure 16 coupled to spool 14 and having ends that are affixed at base 12. End 17 is shown, while the other end is not. Antenna structure 16 is configured to actuate between a stowed state and the illustrated deployed state. The stowed state is defined by antenna structure 16 being wound about spool 14, as will be described below. The deployed state is defined by antenna structure 16 being unwound from around spool 14 to form a loop antenna.

Storage containment device 20 is configured to hold antenna structure 16 in the stowed state, and release mechanism 22 is configured to release antenna structure 16 to allow it to transition into the deployed state. As shown, the storage containment device 20 is a frame with a hinged door defining the release mechanism 22. Other embodiments are contemplated, for example, a tensioned strap could be severed to release antenna structure 16 into the deployed state, or a removeable pin could be inserted into spool 14 adjacent base 12 to hold antenna structure 16 in the stowed state, and withdrawn to allow its deployment. Also, a limiter 24, such as a cable or cord, may be coupled between the spool 14 and the base 12 to limit the travel of spool 14 and, concomitantly, the deployment of antenna structure 16, and aid in defining its resulting shape in the deployed state (e.g., the diamond loop in FIG. 1).

Figure 2:
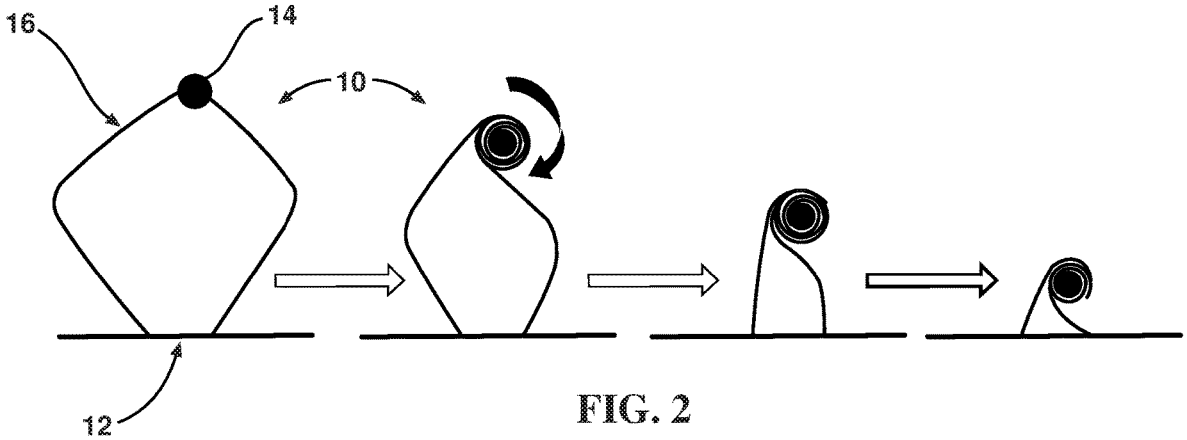
FIG. 2 is a flow diagram illustrating the transition of antenna embodiment of FIG. 1 from the deployed state into the stowed state.
Figure 3:
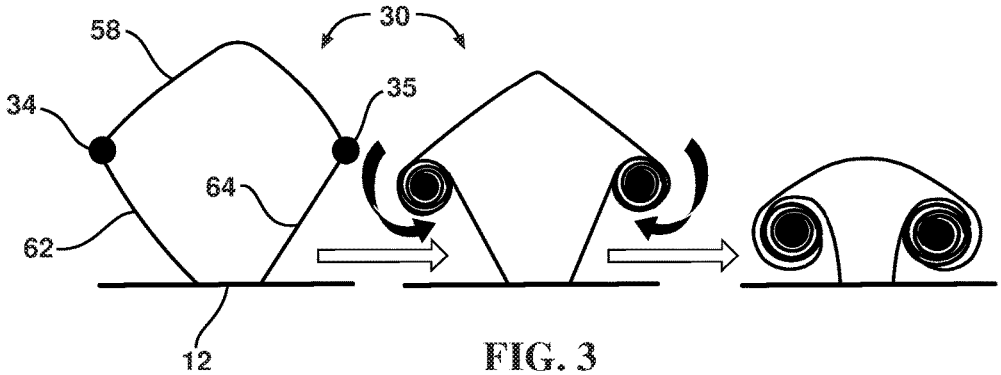
FIG. 3 is a flow diagram illustrating an embodiment of a deployable loop antenna having two spools, and showing the transition of the antenna from the deployed state into the stowed state.
Figure 4:
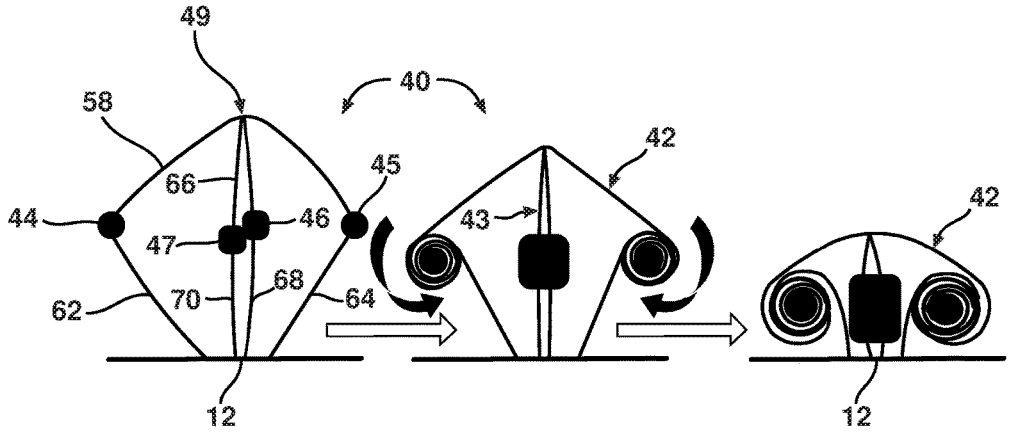
FIG. 4 is a flow diagram illustrating an embodiment of a deployable antenna having four spools and two antenna loop structures lying in intersecting planes, and showing the transition of the antenna from the deployed state into the stowed state.

FIGS. 2-4 illustrate that the common elements of the concept that can be applied to loop antennas in several different configurations. FIG. 2 is a flow diagram illustrating the single spool antenna embodiment of FIG. 1 being rolled up into the stowed state. FIG. 3 is a flow diagram illustrating another embodiment the present invention comprising deployable loop antenna 30, including spool 34 and spool 35. Loop antenna 30 is shown transitioning from the deployed state into the stowed state.

FIG. 4 is a flow diagram illustrating deployable loop antenna 40, another embodiment of the present invention, comprised of antenna structures 42 and 43 using first through fourth spools 44-47. Loop antenna 40 is shown transitioning from its deployed state to its stowed state. In its deployed state, spools 44 and 45 lie in a plane orthogonal to a plane including spools 46 and 47. FIG. 4 shows a benefit of the two spool approach in that two orthogonal loops are coupled at the distal extent 49 of the antenna 40 and stowed together.

Figure 5:
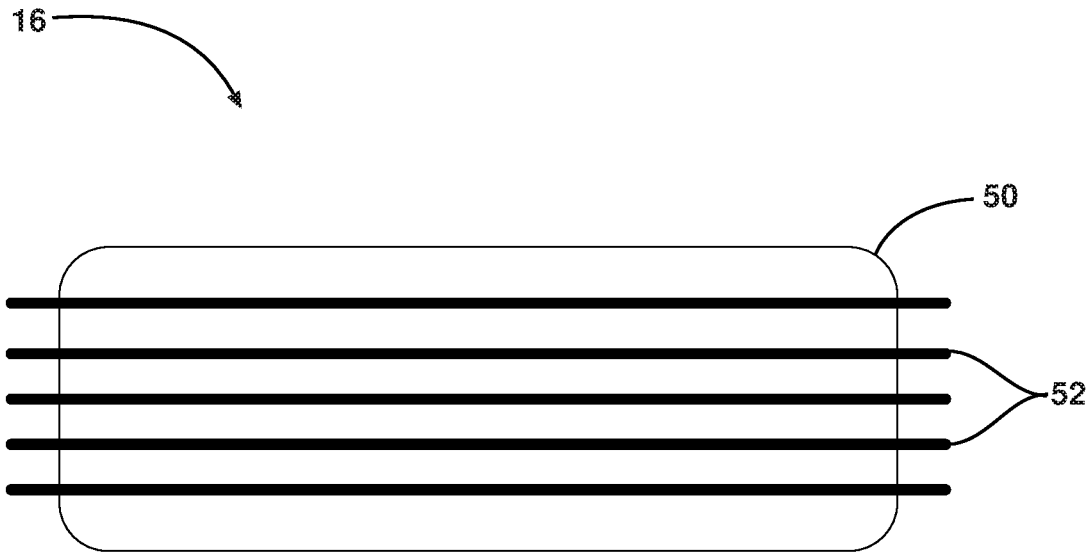
FIG. 5 is a schematic diagram illustrating a portion of an antenna structure comprised of multiple antenna conductors on a flexible substrate.

Referring to FIG. 5, antenna structure 16 may be a bistable composite tape 50 having one or more antenna conductors 52 embedded therein. The antenna conductors 52 may be embedded in parallel in the bistable composite tape 50. The antenna conductors 52 are electrically coupled at or near the base 12 and may include the use of an antenna tuner, a matchbox, antenna tuning unit (ATU), antenna coupler, or feedline coupler coupled between a radio transmitter or receiver and the antenna conductors to improve power transfer between them by matching the impedance of the radio to the antenna's feedline (such features are not shown), as would be appreciated by those skilled in the art. A basic form of antenna 10 includes a single conductor 52 embedded in tape 50, but multiple parallel conductors 52 can be embedded therein to provide additional antenna gain by wiring them to produce a system of several loops, as would be appreciated by those skilled in the antenna art.

Figure 6:
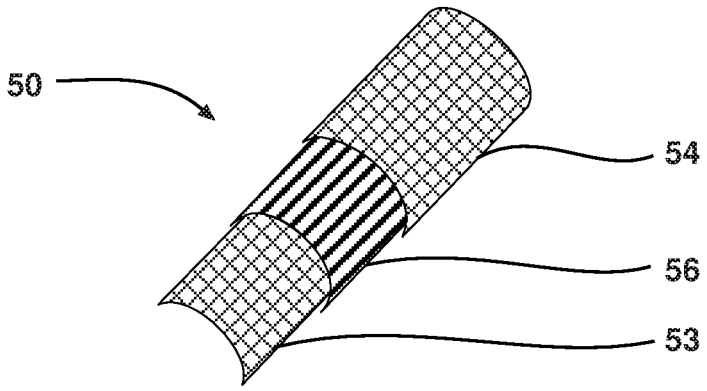
FIG. 6 is a partial cut-away view of a bistable composite tape of the antenna loop structure having a cross-sectional curvature.

As shown in FIG. 6, bistable composite tape 50 has a cross-sectional curvature, and is composed of bistable fiber-reinforced composite tape. The bistable fiber-reinforced composite tape is composed of first and second forty-five degree (45°) biased woven layers 53 and 54 and a unidirectional lamina layer 56 sandwiched therebetween. The utilization of bistable composite tape 50 for antenna structure 16 allows the antenna 10 to roll around the spool 14 in a way that controls the deployment of loop antenna 10. More particularly, the bistability enables linear controlled unrolling of tape 50 along a pre-determined kinematic path without random billowing. The bistability is imparted through the composite layup as well as the curved cross-section.

Figure 7:
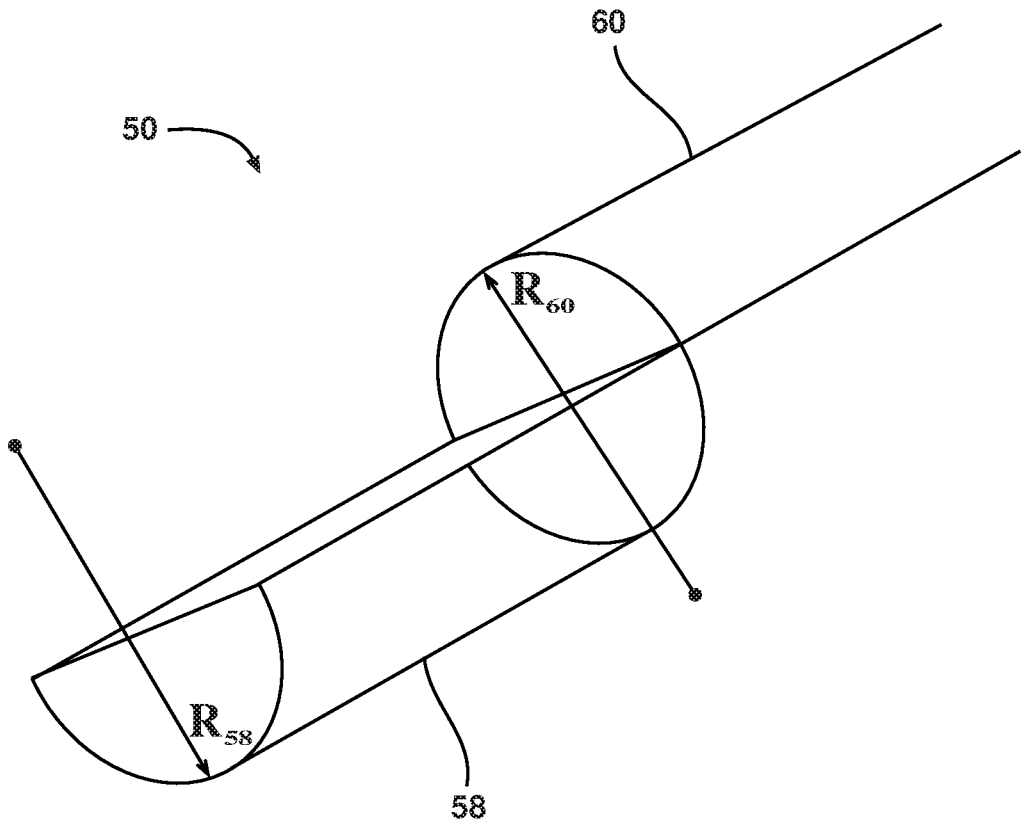
FIG. 7 is a perspective view of a portion of an antenna structure showing its two sections, with each having a curved cross section and the respective radii of curvature pointing in opposite directions.

Referring to FIG. 7, tape 50 is composed of sections 58 and 60 having respective radii of curvature represented by vectors $R_{58}$ and $R_{60}$ drawn from their centers to their curved surfaces, respectively. The vectors thus point towards the concavity in each section. In reference to antenna 10 shown in its deployed state in FIG. 1, sections 58 and 60 would lie on the two sides of spool 14 and base 20, respectively. The concave surface of section 58 thus faces inwards toward the geometric center of the loop of antenna 10, while the concavity of section 60 faces outwardly, away from the geometric center. The orientation of the concavities defined by the directions of $R_{58}$ and $R_{60}$ are shown for the clockwise rotation of spool 14 shown In FIG. 2. If spool 14 were to rotate in a counterclockwise direction, the orientations of $R_{58}$ and $R_{60}$ would be reversed so that the respective concave surfaces would face in the opposite direction as shown. As will be discussed below, tape 50 is flattened when rolled into the stored state.

In reference to antenna 30 in FIG. 3, section 58 could be considered as that section of tape 50 coupling spools 34 and 35, with section 60 being further divided into two sub-sections, sub-section 62 coupling base 12 and spool 34, and sub-section 64 coupling base 12 and spool 35. The underlying principle remains as outlined with respect to antenna 10; that is, the concave surface for section 58 would face toward the geometric center of the loop of antenna 30 when in its deployed state, while the concavities for the two sub-sections 62 and 64 of section 60 would face outwards, away from the geometric center.

Referring to antenna 40 in FIG. 4, antenna structure 42 is comprised of section 58 of tape 50 coupling spools 44 and 45, sub-section 62 coupling base 12 and spool 44, and sub-section 64 coupling base 12 and spool 45. For antenna 40 and antenna structure 42 in the deployed state, the concave surface for section 58 would face inward, toward the geometric center of the loop of antenna structure 42, while the concave surfaces of sub-sections 62 and 64 would face outward, away from the geometric center. For antenna structure 43, section 66 couples spools 46 and 47, with sub-section 68 coupling base 12 and spool 46, and sub-section 70 coupling base 12 and spool 47. The concave surface for section 66 would face inward, toward the geometric center of the loop of antenna structure 43, while the concave surfaces of sub-sections 68 and 70 would face outward, away from the geometric center.

Strain energy is used to actuate the deployment of the antennas 10, 30 and 40. This strain energy is generated and stored by rolling and flattening curved cross sections of the respective antenna structures in the stored state. This means that the loop antennas 10, 30 and 40 can deploy via their own strain energy without any external motors or actuators. A simple release mechanism 22 is used to initiate deployment by releasing the antenna structure from its coiled storage in storage containment device 20. As such, the end 17 and the other end (not shown) of antenna structure 16 are fixed to the base 12 such that in the stowed state, antenna structure 16 stores a strain energy imparted thereto and is configured to be biased toward the deployed state. Without the clamped ends, the bi-stability might actually keep antennas 10, 30 and 40 in their respective stowed states without having the strain energy necessary to deploy them.

Figure 8:
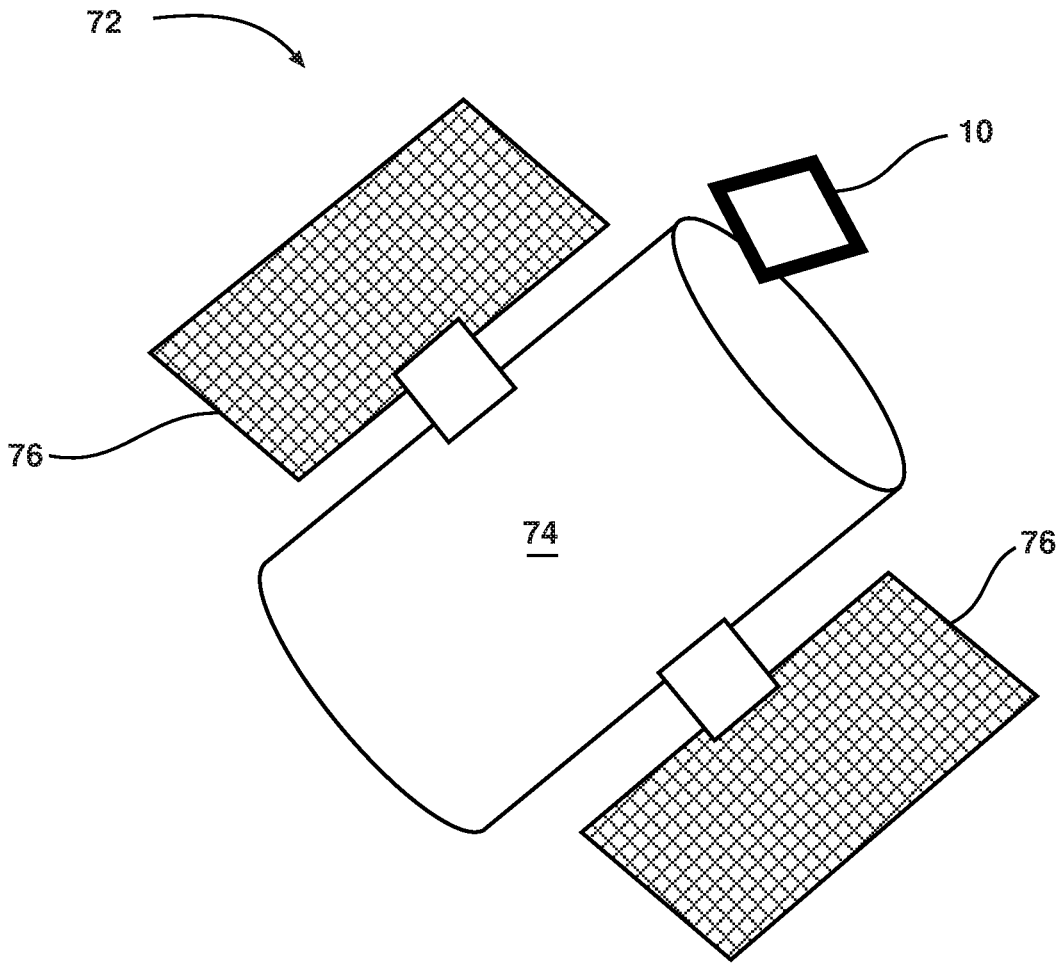
FIG. 8 illustrates a space vehicle with deployment of a deployable loop antenna of the present invention.

Turning to FIG. 8, Antenna 10 (or antennas 30 and 40) are preferably for use with a space vehicle 72, which may be a spacecraft, space capsule, space station and/or satellite, for example. Other spacecraft are also contemplated. Space vehicle 72 may typically include a body 74 housing various electronic components, solar arrays 76 and deployable antenna 10.

The above description provides specific details, such as material types and processing conditions to provide a thorough description of example embodiments. However, a person of ordinary skill in the art would understand that the embodiments may be practiced without using these specific details.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. Thus, the scope of the invention should be determined by the appended claims and their legal equivalents, and not by the examples given.

That which is claimed is:

1. A deployable loop antenna comprising:

a base;

at least one rotatable spool; and a flexible antenna structure coupled to the at least one spool and having ends that are affixed to the base, the antenna structure being configured to actuate between a stowed state and a deployed state; wherein the antenna structure is comprised of two connected sections, a first section and a second section;

when the antenna structure is in the deployed state, the antenna structure and the base form a closed loop having a geometric center, the first section has a first cross-section which is curved to form a first concave surface, and the second section has a second cross section which is curved to form a second concave surface; and the first concave surface generally faces toward the center and the second concave surface generally faces away from the center;

the stowed state is defined by a substantial portion of the antenna structure being wound about the at least one spool; and the deployed state is defined by the antenna structure being unwound from about the at least one spool, to form a loop.

2. The deployable loop antenna of claim 1, wherein the first and second cross-sections are linear when the antenna structure is the stowed state.

3. The deployable loop antenna of claim 2, wherein, when the antenna structure is in the stowed state, the first and second sections generate a strain torque applied to the at least one spool, biased toward forcing the antenna structure into the deployed state.

4. The deployable loop antenna of claim 3, wherein the base includes:

a storage containment device configured to hold the antenna structure in the stowed state by opposing the strain torque with a restraining torque; and a release mechanism configured to reduce or remove the restraining torque, whereby the antenna structure realizes the deployed state.

5. The deployable antenna of claim 1, wherein the antenna structure comprises a bistable fiber-reinforced composite tape having first and second forty-five degree (45°) biased woven layers and a unidirectional lamina layer sandwiched therebetween, and including one or more antenna conductors embedded therein.

6. The deployable loop antenna of claim 1, wherein the at least one spool comprises two spools rotatable in opposite directions and configured to respectively wind two separate sections of the antenna structure to achieve the stowed state.

7. A deployable loop antenna comprising:

a flexible antenna structure having two ends, with both of the ends being affixed to a base, and having a distal section being coupled to a rotatable spool;

the antenna structure and the base forming a closed loop when the antenna is in a deployed state;

a substantial portion of the antenna structure being wound around the spool when the antenna is in a stowed state;

the antenna structure generating a strain force for applying a deployment torque to the spool when the antenna structure is in the stowed state, the deployment torque tending to unwind the antenna structure and thereby transition the antenna from the stowed state into the deployed state;

a storage containment device for applying a restraining torque to the spool opposing the deployment torque when the antenna structure is in the stored state;

the restraining torque having a restraining torque magnitude and the deployment torque having a deployment torque magnitude; and the restraining torque magnitude being greater than the deployment torque magnitude, whereby the antenna is held in the stowed state when the restraining torque is applied to the spool.

8. The deployable loop antenna defined in claim 7, further comprising:

a release mechanism for decreasing the restraining torque magnitude to less than the deployment torque magnitude, whereby the antenna transitions from the stowed state to the deployed state.

9. The deployable antenna of claim 8, wherein the antenna structure comprises a bistable fiber-reinforced composite tape having first and second forty-five degree (45°) biased woven layers and a unidirectional lamina layer sandwiched therebetween, and including one or more antenna conductors embedded therein.

10. The deployable loop antenna further defined in claim 8, comprising a limiter coupled between the spool and the base for limiting deployment of the antenna structure.

11. The deployable loop antenna of claim 10, wherein:

the antenna structure is comprised of two connected sections, a first section and a second section;

when the antenna structure is in the deployed state, the antenna structure and the base form a closed loop having a geometric center, the first section has a first cross-section which is curved to form a first concave surface, and the second section has a second cross section which is curved to form a second concave surface; and the first concave surface generally faces toward the center and the second concave surface generally faces away from the center.

12. The deployable loop antenna of claim 11, wherein the first and second cross-sections are linear when the antenna structure is the stowed state.

13. A deployable loop antenna comprising:

a flexible antenna structure having two ends, with both of the ends being affixed to a base, and being coupled to both a first spool and a second spool;

the antenna structure and the base forming a closed loop when the antenna is in a deployed state;

a major portion of the antenna structure being wound around the two spools when the antenna is in a stored state; and the antenna structure generating a strain force for applying a deployment torque to the first spool and the second spool when the antenna structure is in the stored state, the deployment torque tending to unwind the antenna structure from the first and second spools, and thereby transition the antenna from the stored state to the deployed state.

14. The deployable loop antenna defined in claim 13, wherein:

the antenna structure is comprised of a distal section, a first section and a second section;

the distal section being coupled to and being for winding about the first and second spools;

the first section being affixed to the base and being coupled to and being for winding about the first spool;

the second section being affixed to the base and being coupled to and being for winding about the second spool;

the two spools being rotatable in opposite directions about two parallel axes, respectively;

the antenna structure having a curved cross section when the antenna is in the deployed state and at least part of the antenna structure having a linear cross section when the antenna is in the stored state;

the closed loop having a geometric center; and the distal section having a concave surface facing the center and the first and second sections having respective concave surfaces facing away from the center, when the antenna is in the deployed state.

15. The deployable loop antenna defined in claim 14, wherein the bistable fiber-reinforced composite tape comprises first and second forty-five degree (45°) biased woven layers and a unidirectional lamina layer sandwiched therebetween, and includes one or more antenna conductors embedded therein.

16. The deployable loop antenna of claim 14, wherein the base comprises:

a storage containment device for holding the first antenna structure in the stowed state; and a release mechanism for releasing the first antenna structure into the deployed state.

17. The deployable loop antenna defined in claim 16, wherein the at least one antenna conductor is electrically coupled to or near the base.

18. The deployable loop antenna defined in claim 16 wherein the antenna structure is comprised of two of the antenna structures, with the respective loops formed by the antenna structures lying in orthogonal planes.

* * * * *